United States Patent [19]

Joy

[11] 4,031,596

[45] June 28, 1977

[54] INTEGRATED FINISHING AND COMPRESSIVE PRESHRINKING OF A HIGH-SHRINKAGE FABRIC

[75] Inventor: Herman J. Joy, Latham, N.Y.

[73] Assignee: Cluett, Peabody & Co., Inc., New York, N.Y.

[22] Filed: Jan. 7, 1975

[21] Appl. No.: 539,216

Related U.S. Application Data

[63] Continuation of Ser. No. 262,579, June 14, 1972, abandoned, which is a continuation-in-part of Ser. No. 224,892, Feb. 9, 1972, abandoned.

[52] U.S. Cl. ..... 26/18.6; 28/169

[51] Int. Cl.[2] ..... D06C 21/00

[58] Field of Search ..... 26/18.6; 427/359; 28/74 R

[56] References Cited

UNITED STATES PATENTS

| | | | |
|---|---|---|---|
| 1,982,720 | 12/1934 | Woodhead | 26/18.6 |
| 2,084,367 | 6/1937 | Woodhead | 26/18.6 |
| 2,120,536 | 6/1938 | Woodhead | 26/18.6 |
| 2,870,038 | 1/1959 | MacIntyre | 427/359 |
| 2,885,763 | 5/1959 | Schreiner | 26/18.6 |
| 3,195,210 | 7/1965 | Wehrmann | 26/18.6 |
| 3,229,175 | 1/1966 | Strandberg | 26/18.6 X |
| 3,267,549 | 8/1966 | Rand | 26/18.6 X |
| 3,382,086 | 5/1968 | Singleton | 26/18.6 UX |
| 3,530,510 | 9/1970 | Rabold | 26/18.6 UX |

*Primary Examiner*—Robert R. Mackey

[57] ABSTRACT

This disclosure teaches a method for integrated finishing and compressive preshrinking of a high-shrinkage fabric. The fabric is brought damp from being finished to being compressively preshrunk, rather than according to universally recognized procedure of causing all goods which are to be compressively preshrunk to be in their dry state before the compressive-preshrinking operation. A padder is here employed to impregnate the fabric with finishing liquid, then a series of hot cans reduce the moisture content of the fabric to a range of from 10 to 30%. A moisture content of 15% is preferred. In blended fabrics of cellulosic and man-made fibers, the need for this moisture content is only in the cellulosic component. From the hot cans the fabric is introduced to a compressive-preshrinking unit and the fabric is subsequently dried in a felt-belt dryer.

4 Claims, 1 Drawing Figure

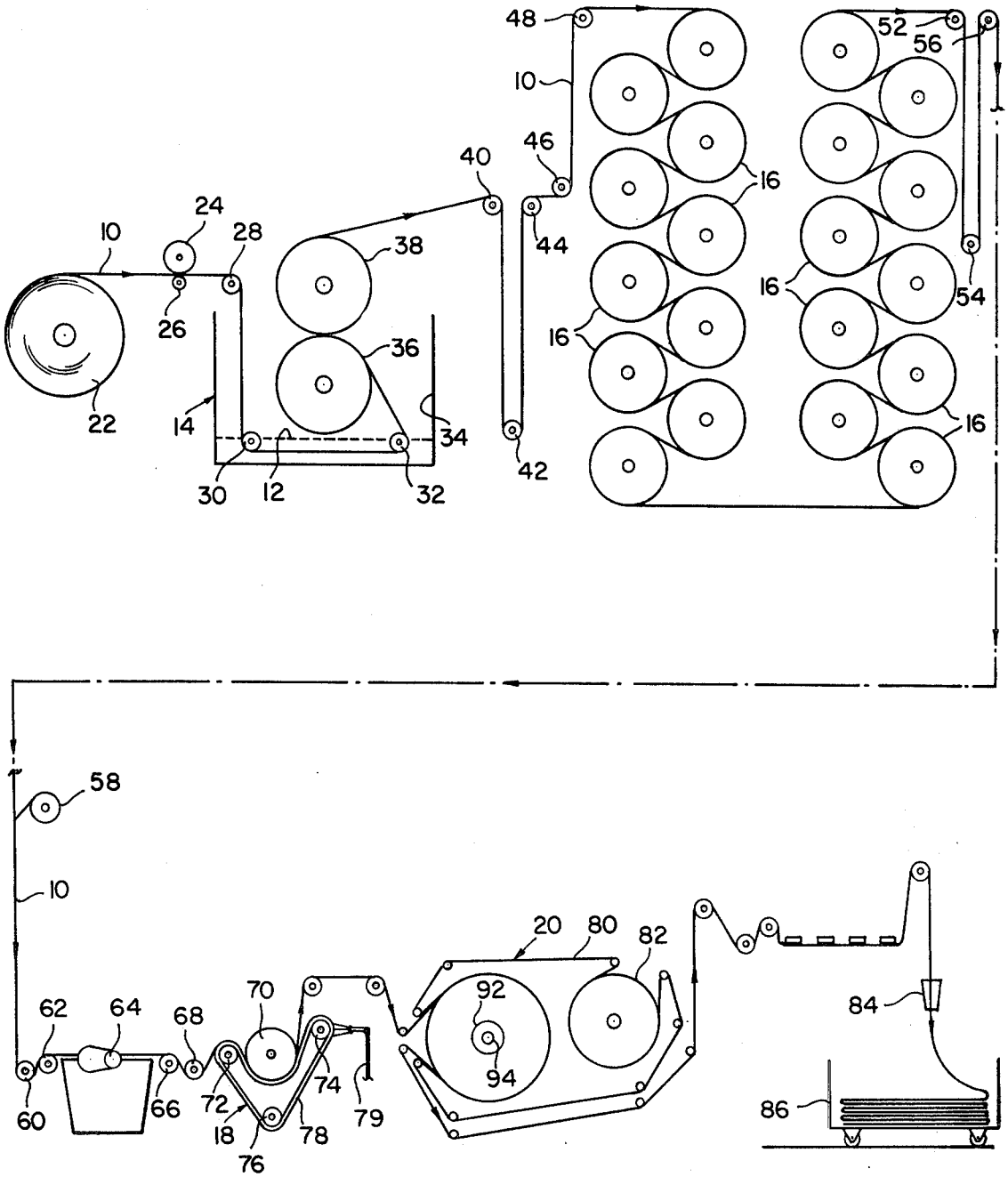
48
10
46
40
24
10
28
38
44
26
36
22
14
34
30
12
32
42
16
16
16
16
52
56
54
58
10
20
80
82
62
64
68
70
92
84
94
60
66
72
74
79
18
78
76
86

INTEGRATED FINISHING AND COMPRESSIVE PRESHRINKING OF A HIGH-SHRINKAGE FABRIC

CROSS REFERENCE TO RELATED APPLICATIONS

This application is a continuation of U.S. Pat. application Ser. No. 262,579 filed June 14, 1972 which was a continuation-in-part of United States pat. application Ser. No. 224,892 filed Feb. 9, 1972 both of which are now abandoned.

BACKGROUND OF THE INVENTION

It has been accepted theory in fabric processing that high-shrinkage fabrics (which generally are not desized before being finished), if fed damp directly from their finishing operations to their compressive-preshrinking operations, would not develop sufficient crystallization of finish starches with the result that desired hand and consistent shrinkage stabilization would be lost. Accordingly, it has been universal practice throughout the world to dry such fabrics between the finishing operation and the compressive-preshrinking operation to assure crystallization of the finish starches. Thereafter these fabrics are remoistened before they are introduced to their compressive preshrinking operations.

A major problem in compressive preshrinking of fabrics is to achieve adequate and uniform dampening of dry fabrics before they are presented to their compressive-preshrinking operations. It is inherently more difficult to acquire a uniform moisture penetration in fabrics if one begins with the fabrics dry than it is to control their moisture contents if one begins with the fabrics wet. Further, padders achieve a greater degree of uniformity of moisture penetration throughout fabrics than do spray boxes. Adequate and uniform moistening of fabrics is rarely achievable under ordinary conditions in conventional spray boxes. Accordingly, one object of this invention is to improve adequacy and uniformity of moisture penetration of such a high-shrinkage fabric.

A further object of this invention is to promote efficiency by integrating the finishing and compressive-preshrinking operations.

A still further object of this invention is to resist creep out of the compressively preshrunk fabric.

A still further object of this invention is to improve appearance of the fabric.

A still further object of this invention is to improve the finish of the fabric.

A still further object of this invention is to eliminate drying and remoistening of the fabric between the finishing operation and the compressive-preshrinking operation.

A still further object of this invention is to control the moisture content of the fabric being introduced to a compressive-preshrinking operation.

BRIEF STATEMENT OF THE INVENTION

The foregoing objectives are achieved in a novel, useful and particularly facile way. Instead of bringing the fabric from dry to moist condition before introduction into a compressive-preshrinking operation, the moistened fabric is only partially dried from a finishing operation. Basically this expedient gives rise to more uniform penetration of the finishing liquid achieved by going from wet to damp rather than from dry to damp.

It is from this basic concept that the other objectives flow.

DRAWING

The accompanying drawing illustrates one embodiment of the invention and shows a preferred method for finishing and compressively preshrinking a high-shrinkage fabric.

PREFERRED EMBODIMENT

As illustrated in the drawing, a preferred method for practicing the present invention comprises impregnating the high-shrinkage fabric 10 with a finishing liquid 12 (which usually includes starches, lubricants, rewetters, hand modifiers and the like) in a padder 14 to a moisture content in excess of 50% by weight, partially drying the impregnated fabric by passing it over a series of hot cans 16 to reduce its moisture content to a range of from 10 to 30% by weight, compressively preshrinking the fabric in a rubber-belt compressive-preshrinking unit 18 and thereafter fully drying the fabric in a Palmer felt-belt dryer 20.

A source of the fabric may be roll 22, a box or other means. Feed of fabric 10 through padder 14 is controlled by padder rolls 36 and 38. Motor 24 which feeds the fabric to padder 14 is monitored by tachometer 26 in a known manner to be described more fully hereinafter. The fabric is conducted over guide rolls 28, 30 and 32 for immersion in finishing liquid 12 contained in trough 34. Thereafter the fabric is squeezed between padder rolls 36 and 38 so that excess finishing liquid is removed and so that uniformity of dispersion of finishing liquid throughout the fabric is assured. Leaving padder 14, the moisture content of fabric 10 is in excess of 50% by weight.

Partial drying of fabric 10 is accomplished by hot cans 16. The fabric is conveyed from padder 14 over hot cans 16 by means of rolls 40,42,44, 46 and 48 and removed from the hot cans 16 by rolls 52, 54 and 46. Dance rolls 42 and 54 may be weighted, if desired. Moisture content is measured by sensor 58 to be sure the moisture content is maintained between 10 and 30% by weight.

Fabric 10 is compressively preshrunk in compressive-preshrinking unit 18. After passing sensor 58, fabric 10 is fed via rolls 60 and 62 to clip expander 64 where it is spread and then via rolls 66 and 68 to compressive-preshrinking unit 18, which includes rotary heated drum 70, a pair of relatively small diameter belt-support rolls 72 and 74 and roll 76 as well as relatively-thick rubber belt 78 that passes beneath drum 70 and around rolls 72, 74 and 76 in that order. The fabric enters the leading nip between belt 78 and drum 70 and becomes longitudinally compressed or preshrunk by the action of belt 70 as its surface portion contacted by the fabric changes from an elongated condition under tension around lead belt-support roll 72 to a compacted condition under compression around drum 70. Spray 79 is also provided.

After fabric 10 is discharged from compressive-preshrinking unit 18, it is passed through a Palmer dryer 20 having felt belt 80 which is heated by drum 82. The fabric is then passed through plaiter 84 which deposits it in successive folds into receiving cart 86 for subsequent delivery to shipping or converting operations. Speed of Palmer felt-belt dryer 20 is controlled by motor 92 monitored by tachometer 94 which is synchronized with tachometer 26 as taught in U.S. Pat.

No. 2,885,763 to Mr. G. A. Schreiner and is well known in the art.

EXAMPLES

A series of tests conducted in accordance with the teaching of this invention on a variety of high-shrinkage fabrics is set forth in the following table:

| | | Potential Shrinkage (Percent) | | | |
|---|---|---|---|---|---|
| | Weight | Before Compressive Preshrinking | | After Compressive Preshrinking | |
| Fabric | Oz. | Warp | Fill | Warp | Fill |
| 1 | 11 ½ | 10.8 | 2.3 | 0.4* | 0.3 |
| 2 | 13 ½ | 9.7 | 2.4 | 3.3* | 0.2 |
| 3 | 11 ¼ | 9.5 | 2.7 | 3.2* | 1.0 |
| 4 | 9 ½ | 10.3 | 2.8 | 1.0* | 0.2 |
| 5 | 13 ½ | 8.5 | 3.0 | 3.0 | 0.8 |
| 6 | 10 | 9.0 | 3.3 | 2.1 | 1.2 |

*indicates overshrinkage

These fabrics were overshrunk, undershrunk and shrunk within a 1% tolerance to observe effects on fabric elongation. Results in all of these tests were good and each of the fabrics were processed as follows:

Greige blue denim fabric from a loom was treated.

The fabric was run through a padder to apply finish to impart desirable hand and resistance to elongation of fabric following compressive preshrinking and wash shrinkage control within "Sanforized" label standards.

The fabric was run over steam heated cans to partially remove moisture to the extent of a remaining 10 to 30% moisture by weight, 17 steam heated cans were used as one unit. The speed was approximately 20 yards per minute. Steam pressure in all of the cans was approximately 15 psi.

Compressive preshrinking was accomplished at approximately 28 to 30 yards per minute on a Morrison rubber-belt compressive-preshrinking unit.

Checks following compressive preshrinking were as follows:

Fabric elongation after
4 hours
0.1% maximum
0.0% minimum
0.0–0.1% average
24 hours
0.4% maximum
0.1% minimum
0.2% average Resistance to stretch or pull-out of compressive preshrinkage when fabric is subjected to flat folding (jerking effect on cloth to mechanically fold the goods in one-yard lengths) was as follows:

Resistance to stretch or pull out: 0.1% in the flat folding operation.

Flat folding is accomplished to prepare goods for delivery to the garment manufacturer. The finishing liquids are batched in 75 gallons of water and comprised the following other ingredients:

| | No. 1 | No. 2 | No. 3 |
|---|---|---|---|
| Polyvinyl Acetate | 16.5 lbs. | 8 lbs. | 16.5 lbs. |
| Starch | 11.0 " | 7 " | 11.0 " |
| Oil | 9.0 " | 7 " | 9.0 " |
| Softener | 5.0 " | 4 " | 6.25 " |

-continued

| | No. 1 | No. 2 | No. 3 |
|---|---|---|---|
| Rewetter | 1.25 " | 1 " | 1.25 " |

Notes:
Mix No. 1 was found to be too stiff, so No. 2 was suggested.
Mix No. 2 was found to elongate in sewing operations a bit too much.
Mix No. 3 was used to overcome elongation in sewing and reduce stiffness.

A double knit fabric from a knitting machine was also treated.

The fabric was moistened in the laboratory in a fashion to simulate moistening in a padder. Other finishing agents could have been added as desired to obtain, desirable hand and resistance to elongation of fabric following compressive preshrinking and wash shrinkage control within prescribed standards.

The fabric was moistened to provide a moisture by weight ratio of 10 to 30%.

Compressive preshrinking was accomplished at approximately 5 yards per minute on a laboratory model.

After about 12 hours the fabric was examined and there was no appreciable fabric elongation from the compressive preshrinking state.

It will be understood by those skilled in finishing and/or preshrinking of fabrics that wide deviations can be made from the foregoing detailed description and examples, witout departing from the main theme of invention set forth in the following claims.

I claim:

1. A method for continuously manufacturing, finishing and preshrinking fabric, the method comprising the sequential steps of:

creating fabric by using conventional machinery, said fabric being known as greige fabric which has been stretched in said machinery and is susceptible therefor of relatively high shrinkage after washing, taking said greige fabric from said machinery to a padder and impregnating said greige fabric with a finishing liquid therein including starch to a moisture content in excess of 50% by weight, partially drying the fabric, measuring and maintaining a moisture content between 10 and 30% by weight, compressively preshrinking the fabric, and fully drying the fabric.

2. A method according to claim 1 wherein the finishing liquid includes starches in combination with lubricants, rewetters, hand modifiers and the like.

3. A method according to claim 1 wherein greige blue denim fabric taken directly from a loom is subjected to impregnation with said finishing liquid, is partially dried, is compressively shrunk and is then fully dried.

4. A method for continuously manufacturing, finishing and preshrinking fabric, the method comprising the sequential steps of:

creating fabric by using conventional machinery, said fabric being known as greige fabric which has been stretched in said machinery and is susceptible therefor of relatively high shrinkage after washing, taking said greige fabric from said machinery to a padder and impregnating said greige fabric with a finishing liquid therein including starch to a moisture content in excess of 50% by weight, passing the fabric over a series of hot cans to partially dry the fabric, measuring and maintaining a moisture content in the fabric between 10 and 30% by weight, compressively preshrinking the fabric in a rubberbelt compressive preshrinking unit, and fully drying the fabric.

* * * * *